United States Patent [19]

Damrau

[11] 4,327,662

[45] May 4, 1982

[54] EDGE DAM ASSEMBLY FOR PAPER COATING APPARATUS

[75] Inventor: Wayne A. Damrau, Wisconsin Rapids, Wis.

[73] Assignee: Consolidated Papers, Inc., Wisconsin Rapids, Wis.

[21] Appl. No.: 139,819

[22] Filed: Apr. 14, 1980

[51] Int. Cl.[3] ..... B05C 3/18

[52] U.S. Cl. ..... 118/410; 118/413

[58] Field of Search ..... 118/407, 411, 410, 413, 118/259, 412; 101/210

[56] References Cited

U.S. PATENT DOCUMENTS

| | | | |
|---|---|---|---|
| 907,638 | 12/1908 | Page | 101/210 |
| 2,151,968 | 3/1939 | Henderson | 101/157 |
| 2,525,363 | 10/1950 | Luehrs | 101/210 X |
| 2,796,846 | 6/1957 | Trist | 118/410 |
| 3,169,082 | 2/1965 | Krikorian | 118/413 |
| 3,252,443 | 5/1966 | Growdon et al. | 118/407 |
| 3,980,043 | 9/1976 | Pomper | 118/259 X |

*Primary Examiner*—John P. McIntosh

*Attorney, Agent, or Firm*—Gary, Juettner & Pyle

[57] ABSTRACT

An improved edge or end dam assembly for an applicator for applying a coating liquid to a web of moving paper carried on a backing roll, the applicator being of the type having a chamber for receiving the coating liquid and an opening therein for directing the liquid onto the web, the opening being formed between a front wall of the chamber and a doctor blade extending from the rear of the opening to against the web, is characterized by a seal element sealed with the front wall and doctor blade in an end space therebetween and extending toward and closely adjacent but spaced from the web. The face of the seal element adjacent the paper web has a plurality of grooves extending generally parallel to the direction of movement of the web, so that coating material which seeps past the seal element and beyond the edge dam assembly enters the grooves and is moved by the web toward the doctor blade for deposit on the web. In this manner, leakage of coating material past the seal element is significantly minimized, and pressure of coating material on the web may be maintained.

17 Claims, 8 Drawing Figures

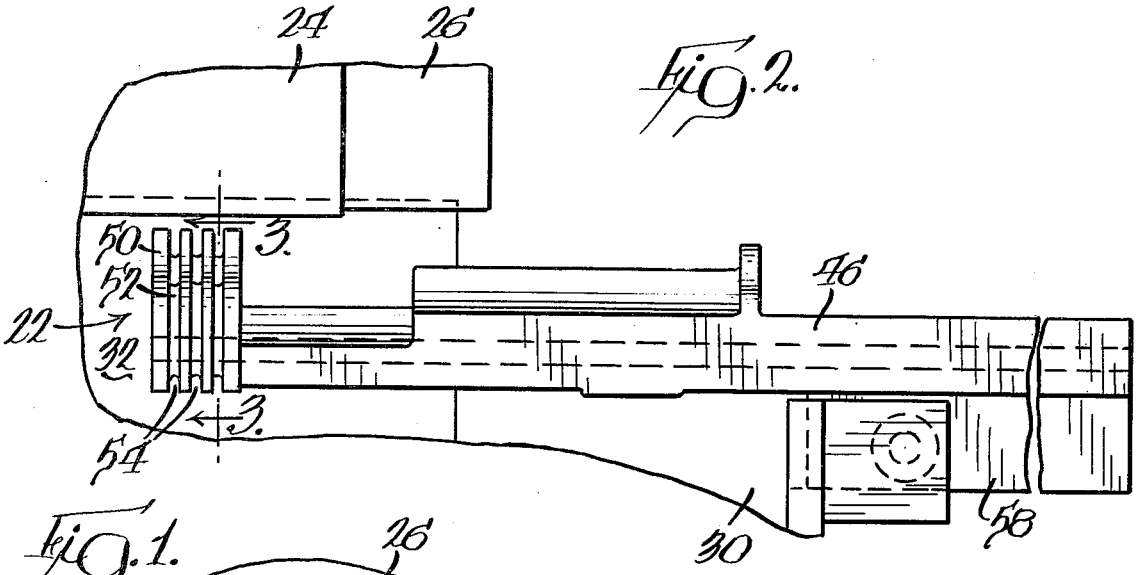
Fig. 2.
Fig. 1.
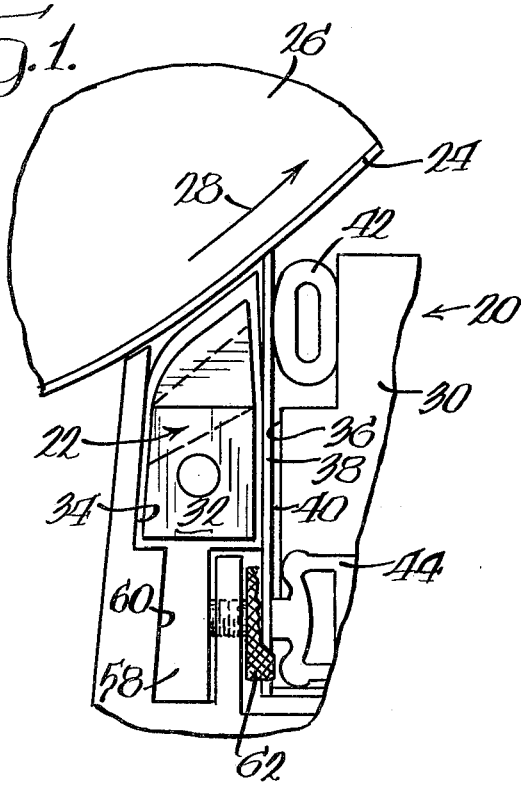
Fig. 3.
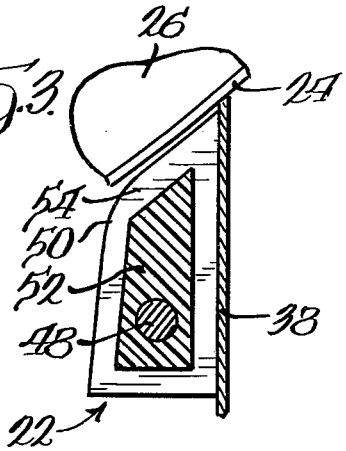
Fig. 4.
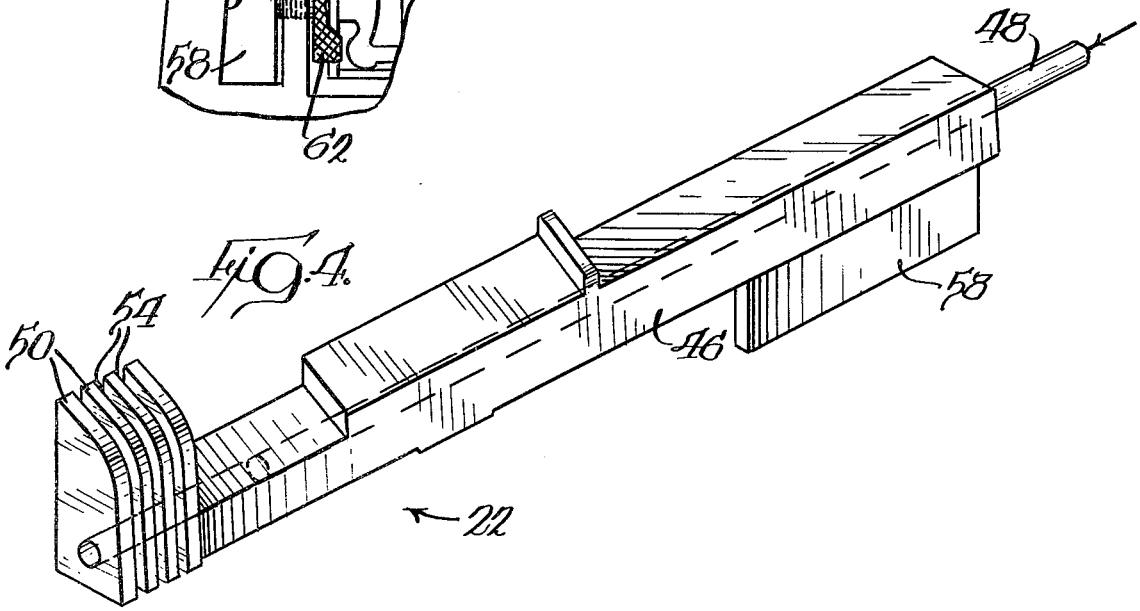

EDGE DAM ASSEMBLY FOR PAPER COATING APPARATUS

BACKGROUND OF THE INVENTION

The present invention relates to an improved edge dam for use with applicators of the trailing blade type for applying a coating liquid to a web of moving paper.

Conventional applicators of the trailing blade type include means for applying coating material to a paper web that is usually supported and carried by a resilient backing roll. Such applicators may include a chamber having an opening extending across and parallel to the web, together with a doctor blade located on a trailing side of the opening, which serves to level the coating, and a front wall extending from a leading side of the opening toward the web. Means are provided for supplying a coating liquid to the chamber, and thence through the chamber opening and between the front wall and doctor blade to the web. To seal the end spaces between the front wall and doctor blade to prevent escape of coating material laterally of the web, edge dam means are provided thereat.

For applicators of the foregoing types, the edge dam means may comprise a flexible element at each end space for sealing with the front wall, doctor blade and paper web. Ideally, the edge dam absolutely prevents passage of any coating liquid to exterior of the chamber. However, in practice coating liquid often leaks past the edge dam, with the result that the backing roll or web edges become contaminated, for example by stickers on the roll of coated paper.

OBJECTS OF THE INVENTION

A primary object of the present invention is to provide improved edge dam assemblies for applicators for applying a coating liquid to a web of moving paper, which significantly decrease seepage of coating liquid beyond the areas of the web to be coated and enable coating liquid pressure on the web to be maintained.

SUMMARY OF THE INVENTION

In accordance with the present invention, an improved edge dam assembly for use with an applicator for applying a coating liquid to a web of moving paper carried on a backing roll, wherein the applicator is of a type having a body portion defining a chamber therein and an elongate opening thereto positionable generally adjacent and transversely of the web, the chamber receiving coating liquid and directing the same through the opening and onto the web, comprises seal means mountable in the opening in sealed engagement with the body portion on opposite sides of the chamber opening and extending toward and closely adjacent but spaced from the paper web or backing roll.

In one embodiment, said seal means has at least one groove formed therein adjacent the paper web or backing roll, and surfaces on opposite sides of said groove which extend toward and closely adjacent the paper web or backing roll. Said groove extends in a direction generally along the direction of movement of the paper web thereat, and receives therein coating liquid seeping past said surfaces.

In another embodiment, said seal means comprises a plurality of generally planar first and second elements interleaved side by side to alternate said first and second elements. Said first and second elements seal with the body portion on opposite sides of the chamber opening, extend toward and closely adjacent the paper web or backing roll, and form said at least one groove extending in a direction generally along the direction of movement of the paper web thereat. Preferably, each of said first elements has a peripheral groove formed therein adjacent the paper web or backing roll, and surfaces on opposite sides of said groove which extend toward and closely adjacent the paper web or backing roll. Each said first element is of a size insufficient, and each said second element is of a size sufficient, to engage and seal with the body portions on opposite sides of the chamber opening, and each said second element has an open ended notch extending from an edge thereof to a medial point therein in a direction generally along the body portions. The width of each said second element is greater than the spacing between the body portions, and said notch permits compression of said second elements so that the same fit between and seal with the body portions.

By virtue of the groove or grooves formed in the seal means, coating liquid which seeps out of the chamber and past the seal means falls into the grooves and is conveyed therein toward the paper web for deposit on the web. In this manner, leakage of coating material past the seal means is significantly minimized, thereby preventing contamination of the paper web and/or backing roll and enabling a positive pressure of coating liquid to be maintained against the web.

The foregoing and other objects, advantages and features of the invention will become apparent upon a consideration of the following detailed description, when taken in conjunction with the accompanying drawings.

BRIEF DESCRIPTION OF THE DRAWINGS

FIG. 1 is a side elevation view of one embodiment of edge dam assembly in accordance with the teachings of the present invention, illustrating the same on an applicator for applying a coating liquid to a moving web of paper carried on a backing roll;

FIG. 2 is a longitudinal view of the edge dam assembly of FIG. 1, showing its orientation with respect to the web of paper and backing roll;

FIG. 3 is a cross-sectional side elevation view of the edge dam assembly, taken substantially along the lines 3—3 of FIG. 2;

FIG. 4 is a perspective view of the one embodiment of edge dam assembly;

DETAILED DESCRIPTION

Figure 5:
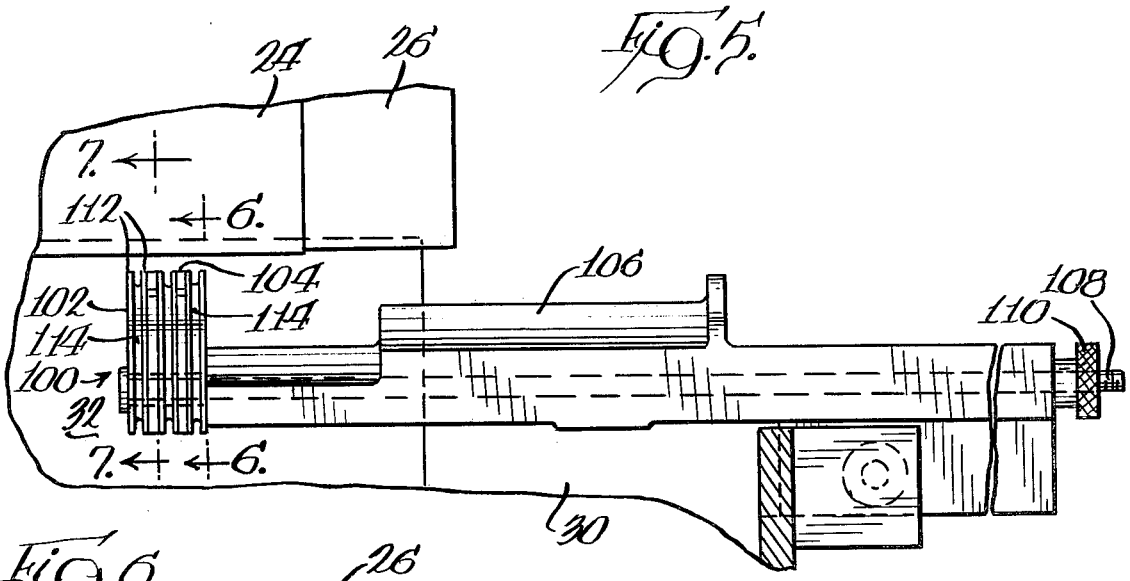
FIG. 5 is a longitudinal view of an edge dam assembly structured in accordance with another embodiment of the invention, illustrating its orientation with respect to a web of paper and a backing roll.

Referring to FIG. 1, there is indicated generally at 20 an applicator of a type with which an edge or end dam assembly, indicated generally at 22 and configured in accordance with one embodiment of the invention, is particularly adapted for use. The applicator applies a pigment bearing liquid coating to a moving web of paper 24 carried on a resilient backing roll 26 in a direction indicated by an arrow 28, and includes a main support or housing 30 having a coating liquid chamber 32 defined between a front or leading wall 34 and a rear or trailing wall 36 of the support. The walls extend generally transversely of and parallel to the backing roll, and taper toward an open upper end of the chamber. Coating liquid is introduced into the chamber for flowing through the opening and against the web of paper, and although not shown, the sides of the chamber are closed by side walls extending between the front and rear walls 34 and 36.

During operation, the coating applicator is positioned closely adjacent the backing roll 26 with the opening in the upper end of the chamber 32 facing the surface of the paper web 24. A flexible doctor blade 38 is in a slot 40 in the main support 30 to form a portion of the chamber rear wall, and is clamped in place against the edge dam assembly 22 and urged against the web by a pair of transversely extending air tubes 42 and 44. The doctor blade serves several functions, one of which is to level the coating applied to the web, and another of which is to form a seal at the trailing end of the applicator to prevent escape therepast of excessive amounts of coating liquid. The pressure of the blade on the roll is conveniently regulated by the pressure of the air within the tube 42, the tube for this purpose resulting in an even pressure of the doctor blade across the entire width of the paper web.

To accomplish sealing of the spaces at the side ends of the doctor blade 38 and the front wall 34 of the applicator main support 30, an edge dam assembly in positioned at each side end. As shown in FIGS. 2, 3 and 4, which illustrate the generally integral edge dam assembly 22 configured in accordance with the one embodiment of the invention, the assembly is preferably of nylon or polypropylene and includes a mounting and support member 46 which has a channel therein into which is pressed a steel rod 48 for rigidity or stiffening of the assembly. A plurality of quasi-triangular seal elements 50 are at one end of the support member, and spacer portions 52, of a smaller size than the seal elements, separate the seal elements to define peripheral grooves 54 between adjacent elements.

The generally triangular shape of the seal elements 50 enables the edge dam assembly 22 to be mounted in the space between the doctor blade 38, the front wall 34 and the backing roll 26 at the opening from the chamber 32. For the purpose, and as shown in FIG. 1, the mounting and support member 46 has a downwardly depending mounting flange 58 which is received within a slot 60 in the applicator main support 30 and secured therein by a knob 62 having a threaded portion passing through a threaded opening in the main support into clamped engagement with the flange. The knob enables the edge dam assembly to be conveniently removed from the applicator by being slid transversely therefrom for cleaning, repair or replacement. With the edge dam assembly mounted between the doctor blade and front wall, the upper ends of the seal elements 50, separated by the grooves 54, extend toward and closely adjacent to but spaced from the paper web 24 toward a side edge thereof, and generally form a seal therewith to control passage of coating liquid therepast.

FIG. 2 illustrates the mounting arrangement of the edge dam assembly 22 on the applicator main support 30. As is seen, when mounted on the main support the seal elements 50 and the peripheral grooves 54 lie in planes extending generally perpendicular to the axis of rotation of the backing roll 26, or parallel to the direction of movement of the paper web. This particular arrangement has been found to provide enhanced sealing capability with the paper web and, as compared with prior edge dam assemblies of the conventional type in which the seal element adjacent the web defines a continuous sealing surface without any grooves, substantially minimizes passage of coating material from the chamber 32 past the edge dam assembly. This may be appreciated if it is considered that each seal element 50 generally forms a separate seal with the paper web, and that coating liquid which seeps past a seal element moves into a groove 54 before it encounters the following seal element. The grooves in the sealing surface thus receive and contain coating liquid which seeps past the seal elements, the flow of which must be controlled. Then, as the backing roll rotates, coating liquid in the grooves is drawn by the paper web toward the doctor blade 38 for application onto the web, which minimizes the amount of coating liquid available for seepage past the following seal elements and ultimately beyond the edge dam assembly. The flow of coating liquid within the grooves is orthogonal to the direction of flow of liquid which must be controlled, so that the grooves reduce the quantity of seepage of coating liquid past the edge dam assembly to a considerably greater extent than could otherwise be accomplished with a non-grooved sealing surface.

As is apparent, the configuration and size of the edge dam assembly is quite important relative to the position of the doctor blade 38. That is, the seal elements 50 must be of a size to substantially fill the area defined between the doctor blade, the front wall 34 of the applicator main support 30 and the backing roll 26 when the doctor blade is in its doctoring position. If the seal elements are too small, coating material will seep therepast. If the seal elements are two large, the doctor blade will be held from its doctoring position against the paper web.

To obtain a secure seal between the doctor blade 38 and the leading wall 34 of the applicator main support 30, and yet to ensure that the doctor blade will not be held from its doctoring position against the paper web, in accordance with another embodiment of the invention, and as shown in FIGS. 5–8, a composite edge dam assembly, indicated generally at 100, is provided. In this embodiment, the edge dam assembly includes a plurality of separate seal elements 102, adjacent ones of which are separated by spacers 104. The seal elements and spacers are interleaved and supported at an end of a mounting member 106 by a rod 108 extending through aligned passages in the seal elements, spacers and mounting member. One end of the rod is fastened to the outermost seal element, and an opposite end is threaded and provided with a knurl nut 110, which may be tightened to draw the seal elements, spacers and mounting member together.

The seal elements each have a pair of sealing surfaces 112 and a peripheral groove 114 between the surfaces, and each spacer 104 has an open ended notch 116 extending from an upper surface thereof to a medial point therein. The height of each sealing element 102 is such that its upper sealing surfaces 112 extend toward and adjacent to but slightly spaced from the paper web when the edge dam assembly 100 is mounted on the applicator main support 30, but the width of each is less than the spacing between the front wall 34 of the main applicator and the doctor blade 38 when the doctor blade is doctoring the paper web. Thus, the seal elements do not restrict doctor blade movement against the paper web. Each spacer 104, on the other hand, although having a height which may be equal to or less than that of the seal elements, has a width which is greater than the distance between the front wall of the applicator main support and the doctor blade when the doctor blade is doctoring the paper web. However, because of the notches 116, upon loading of the doctor blade by the air tube 42, the side edges of the spacers flex inwardly and together to enable the doctor blade to move to a doctoring position against the paper web, and at the same time form secure seals with the doctor blade and the forward wall of the main support.

Figure 6:
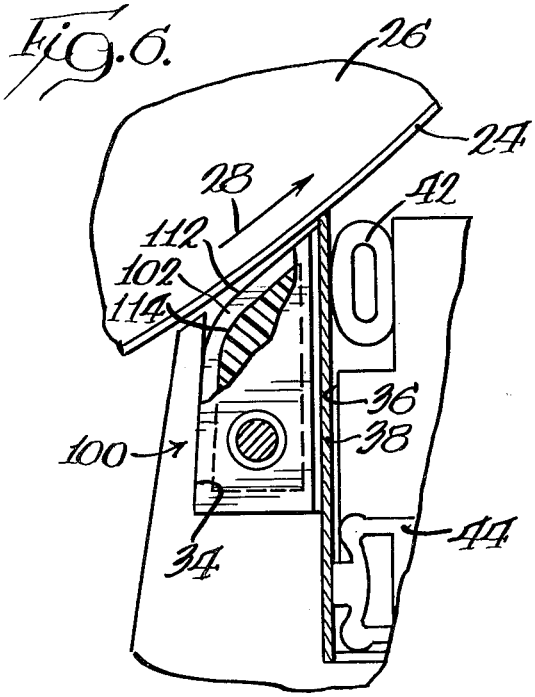
FIG. 6 is a side elevation view, partly in cross section, taken substantially along the lines 6—6 of FIG. 5, showing the edge dam assembly on an applicator for applying a coating liquid to the moving web of paper carried on the backing roll.
Figure 7:
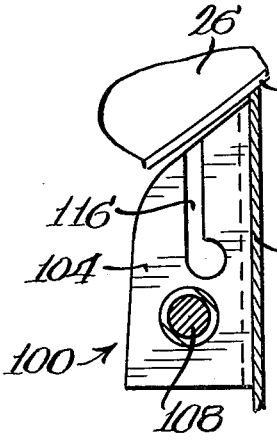
FIG. 7 is a side elevation view, partly in cross section, of the edge dam assembly, and is taken substantially along the lines 7—7 of FIG. 5.
Figure 8:
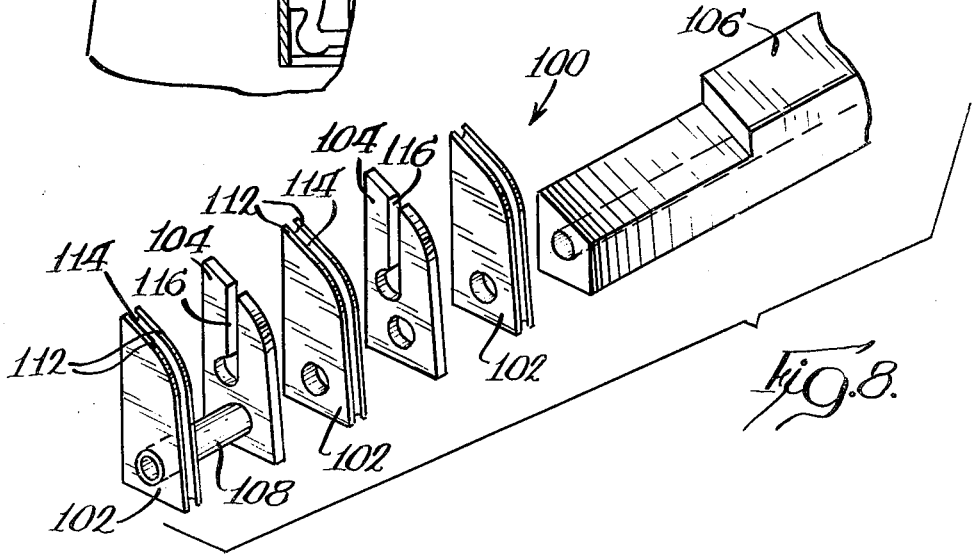
FIG. 8 is a perspective assembly view of the edge dam assembly shown in FIGS. 5–7.

FIGS. 5 and 6 show the positioning of the edge dam assembly 100 with respect to the paper web 24 when the assembly is mounted on the applicator main support 30. As is apparent, because of the grooves 114 in the seal elements 102, the edge dam assembly 100 operates in the same manner as the edge dam assembly 22 to minimize seepage of coating liquid therepast. Also, although the edge dam assembly is illustrated as comprising three seal elements and two spacers, more or less seal elements and spacers could be used, it being understood that since the seal elements seal the passages through the spacers, that would otherwide be provided by the notches 116, formation of an efficient seal requires use of at least two seal elements.

While embodiments of the invention have been described in detail, various modifications and other embodiments thereof may be devised by one skilled in the art without departing from the spirit and scope of the invention, as defined in the appended claims.

What is claimed is:

1. An improved edge dam assembly for use with an applicator for applying a coating liquid to a web of moving paper carried on a movable support, wherein the applicator is of a type having a body portion defining a chamber therein with a elongate opening thereto positionable generally below, adjacent and transversely of the web, the chamber receiving coating liquid and directing the same generally upwardly through the opening and onto the web, said edge dam assembly comprising seal means at each end of the opening mountable in the opening generally below the web for sealing along side surfaces thereof with the body portion on opposite sides of the opening and for extending at upper surfaces thereof toward and closely adjacent to but spaced from the web for sealing therewith, each said seal means having a plurality of spaced grooves formed therein along said side and upper surfaces thereof, the interiors of said grooves being substantially at atmospheric pressure and said grooves in said upper surface extending generally along the direction of movement of the web thereat, whereby coating liquid seeping past said seal means enters and gravitates through said grooves.

2. An improved edge dam assembly as in claim 1, wherein said side and upper surfaces of each said seal means define sealing surfaces on opposite sides of said grooves, said sealing surfaces of said top surface extending toward and closely adjacent to but spaced from the paper web or backing roll.

3. An improved edge dam assembly as in claim 1, wherein said grooves lie in generally parallel planes.

4. An improved edge dam assembly as in claim 3, wherein said side and upper surfaces of each said seal means define sealing surfaces on opposite sides of said grooves, said sealing surfaces on said side surfaces sealing with the body portions on opposite sides of the chamber and said sealing surfaces on said upper surface extending toward and closely adjacent to but spaced from the paper web.

5. An improved edge dam assembly as in claim 1, wherein eash said seal means comprises a plurality of generally planar first and second elements interleaved side by side to alternate said first and second elements, said first and second pluralities of elements being dimensioned to form said plurality of spaced grooves.

6. An improved edge dam assembly as in claim 5, wherein said first and second elements lie in planes extending generally parallel to the direction of movement of the web.

7. An improved edge dam assembly as in claim 5, wherein each of said first elements has a peripheral groove in and along its upper and side surfaces and sealing surfaces, on said upper surface on opposite sides of said groove, extending toward and closely adjacent to but spaced from the paper web.

8. An improved edge dam assembly as in claim 7, wherein said second elements have surfaces for sealing with the body portions on opposite sides of the chamber opening.

9. An edge dam assembly as in claim 1 or 5, comprising a pair of said assemblies, each for being mounted at an opposite end of the applicator chamber opening.

10. An improved edge dam assembly for use with an applicator for applying a coating liquid to a web of moving paper carried on a backing roll, wherein the applicator is of a type having a body portion defining a chamber therein with an elongate opening thereto positionable generally adjacent and transversely of the web, the chamber receiving coating liquid and directing the same through the opening and onto the web, said edge dam assembly comprising seal means mountable in the opening for sealing with the body portion on opposite sides of the chamber opening and for extending toward and closely adjacent to but spaced from the paper web or backing roll, said seal means having a plurality of spaced grooves formed therein whereat the same is adjacent to the paper web or backing roll, the interiors of said grooves being substantially at atmospheric pressure and said grooves extending generally along the direction of movement of the paper web thereat and receiving therein coating liquid seeping past said seal means, wherein each said seal means comprises a plurality of generally planar first and second elements interleaved side by side to alternate said first and second elements, said first and second pluralities of elements are dimensioned to form said plurality of spaced grooves, each of said first elements has a peripheral groove in and along its upper and side surfaces and sealing surfaces, on said upper surface on opposite sides of said groove, extending toward and closely adjacent to but spaced from the paper web or backing roll, said second elements have surfaces for sealing with the body portions on opposite sides of the chamber opening, and each of said second elements has an open ended notch extending from an edge thereof to a medial point therein in a direction generally along the body portions, and a width between the body portions which is greater than the spacing between the body portions, said notch permitting compression of said second elements so that the same fit between and seal with the body portions.

11. An improved applicator and edge dam assembly for applying a coating liquid to a web of moving paper carried on a movable support, comprising a body portion defining a chamber therein having an opening thereto extending substantially below, across and parallel to the web, said chamber for receiving coating liquid and directing the same generally upwardly through said opening onto the web; a front wall extending from a front side of said chamber opening toward, substantially across the parallel to the web; a doctor blade extending from a rear side of said chamber opening substantially across, parallel to and against the web for doctoring the coating liquid on the web; and edge dam means generally below the web at each opposite side end of said front wall and doctor blade for sealing the end spaces therebetween, each said edge dam means comprising seal means mounted between said front wall and said doctor blade and having side surfaces in sealed engagement therewith and extending at an upper surface thereof toward and closely adjacent to but spaced from the paper web or backing roll, said seal means having a plurality of spaced grooves formed therein along said side and upper surfaces thereof and said upper and side surfaces defining sealing surfaces on opposite sides of said grooves, said sealing surfaces on said side surfaces sealing with said front wall and doctor blade and said sealing surfaces on said upper surface extending toward and closely adjacent to but spaced from the paper web, the interiors of said grooves being substantially at atmospheric pressure and said grooves in said upper surface extending generally along the direction of movement of the paper web thereat, whereby coating liquid seeping past said sealing surfaces gravitates into said grooves.

12. An improved applicator and edge dam assembly as in claim 11, wherein said grooves in said side surfaces are contiguous with associated ones of said grooves in said upper surface and said grooves lie in planes extending generally parallel to the direction of web movement.

13. An improved applicator and edge dam assembly as in claim 11, wherein each said seal means comprises a plurality of generally planar first and second elements interleaved side by side to alternate said first and second elements, said first and second pluralities of elements being dimensioned to form said plurality of grooves and said sealing surfaces on opposite sides of said grooves.

14. An improved applicator and edge dam assembly as in claim 13, wherein said first and second elements lie in planes extending generally parallel to the direction of movement of the web, said first elements have said sealing surfaces extending toward and closely adjacent to but spaced from the paper web or backing roll and said second elements have said sealing surfaces for sealing with said front wall and said doctor blade.

15. An improved applicator and edge dam assembly as in claim 14, wherein each of said first elements has a peripheral groove in and along its upper and side surfaces and said sealing surfaces on said upper surface being on opposite sides of said groove and extending toward and closely adjacent to but spaced from the paper web.

16. An improved applicator and edge dam assembly as in claim 15, wherein said second elements have said sealing surfaces for forming a seal with said front wall and said doctor blade.

17. An improved applicator and edge dam assembly for applying a coating liquid to a web of moving paper carried on a backing roll, comprising a body portion defining a chamber therein having an opening thereto extending substantially across and parallel to the web, said chamber for receiving coating liquid and directing the same through said opening onto the web; a front wall extending from a front side of said chamber opening toward, substantially across and parallel to the web; a doctor blade extending from a rear side of said chamber opening substantially across, parallel to and against the web for doctoring the coating liquid on the web; and edge dam means at each opposite side end of said front wall and doctor blade for sealing the end spaces therebetween, each edge dam means comprising seal means mounted between said front wall and said doctor blade in sealed engagement therewith and extending toward and closely adjacent to but spaced from the paper web or backing roll, said seal means having a plurality of spaced grooves formed therein whereat the same is adjacent to the paper web or backing roll, said seal means having sealing surfaces on opposite sides of said grooves extending toward and adjacent to but spaced from the paper web or backing roll and the interiors of said grooves being substantially at atmospheric pressure and said grooves extending generally along the direction of movement of the paper web thereat and receiving therein coating liquid seeping past said sealing surfaces, wherein each said seal means comprises a plurality of generally planar first and second elements interleaved side by side to alternate said first and second elements, said first and second pluralities of elements are dimensioned to form said plurality of grooves and said sealing surfaces on opposite sides of said grooves, said first and second elements lie in planes extending generally perpendicular to the axis of rotation of the backing roll, said first elements have surfaces extending toward and closely adjacent to but spaced from the paper web or backing roll and said second elements have surfaces for sealing with said front wall and said doctor blade, wherein each of said first elements has a peripheral groove along its surface toward the paper web or backing roll, said groove extending generally along the direction of movement of the paper web thereat and said first element having said sealing surfaces, on opposite sides of said groove, extending toward and closely adjacent to but spaced from the paper web or backing roll, said second elements have said sealing surfaces for engaging and forming a seal with said front wall and said doctor blade and wherein each of said second elements has an open ended notch extending from an edge thereof to a medial point therein in a direction generally along said front wall and said doctor blade, and a width between said front wall and said doctor blade which is greater than the spacing between said front wall and said doctor blade, said notch permitting compression of said second elements so that the same fit between said front wall and said doctor blade, form seals therewith and enable said doctor blade to move against the web for doctoring the coating liquid thereon.

* * * * *